US010180272B2

(12) United States Patent
Bahel et al.

(10) Patent No.: US 10,180,272 B2
(45) Date of Patent: Jan. 15, 2019

(54) REFRIGERANT CHARGE DETECTION FOR ICE MACHINES

(71) Applicant: Emerson Climate Technologies, Inc., Sidney, OH (US)

(72) Inventors: Vijay Bahel, Sidney, OH (US); Kurt James Knapke, St. Marys, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 15/960,077

(22) Filed: Apr. 23, 2018

(65) Prior Publication Data

US 2018/0238599 A1 Aug. 23, 2018

Related U.S. Application Data

(63) Continuation of application No. 14/824,826, filed on Aug. 12, 2015, now Pat. No. 9,951,985.
(Continued)

(51) Int. Cl.
*G01K 13/00* (2006.01)
*F25B 49/02* (2006.01)
*F25B 49/00* (2006.01)

(52) U.S. Cl.
CPC ..... *F25B 49/025* (2013.01); *F25B 49/005* (2013.01); *F25B 2345/003* (2013.01);
(Continued)

(58) Field of Classification Search
CPC ..... F25B 49/025; F25B 49/005; F25B 2700/2106; F25B 2700/21152; F25B 2700/1933; F25B 2700/1931; F25B 2700/151; F25B 2700/2116; F25B 2600/024; F25B 2500/24; F25B 2500/23; F25B 2500/19; F25B 2345/003; F25B 2600/23
See application file for complete search history.

(56) References Cited

U.S. PATENT DOCUMENTS 6,571,566 B1 6/2003 Temple et al.
6,886,354 B2 5/2005 Dudley
(Continued)

FOREIGN PATENT DOCUMENTS

KR 20050105519 A 11/2005
WO WO-2013101701 A1 7/2013

OTHER PUBLICATIONS

International Search Report regarding International Application No. PCT/US2015/045073, dated Oct. 28, 2015.
(Continued)

*Primary Examiner* — Ljiljana Ciric
(74) *Attorney, Agent, or Firm* — Harness, Dickey & Pierce, P.L.C.

(57) ABSTRACT

A system includes a compressor driven by a motor. A condenser receives working fluid from the compressor. An evaporator is in fluid communication with the condenser and the compressor. A first sensor produces a first signal, and a second sensor produces a second signal. A processing circuitry processes the first signal and the second signal to determine a new baseline freeze time. The processing circuitry determines the new baseline freeze time for a predetermined time following an installation event, a service event, or a power outage of the compressor.

26 Claims, 12 Drawing Sheets

FIG. 5

Related U.S. Application Data

(60) Provisional application No. 62/036,702, filed on Aug. 13, 2014.

(52) U.S. Cl.
CPC ..... *F25B 2500/19* (2013.01); *F25B 2500/23* (2013.01); *F25B 2500/24* (2013.01); *F25B 2600/024* (2013.01); *F25B 2600/23* (2013.01); *F25B 2700/151* (2013.01); *F25B 2700/1931* (2013.01); *F25B 2700/1933* (2013.01); *F25B 2700/2106* (2013.01); *F25B 2700/2116* (2013.01); *F25B 2700/21152* (2013.01)

(56) References Cited

U.S. PATENT DOCUMENTS

| | | | | |
|---|---|---|---|---|
| 8,393,169 | B2 | 3/2013 | Pham | |
| 2004/0194485 | A1 | 10/2004 | Dudley | |
| 2005/0109056 | A1 | 5/2005 | Rand et al. | |
| 2006/0021362 | A1 | 2/2006 | Sadegh et al. | |
| 2008/0092574 | A1 | 4/2008 | Doberstein | |
| 2018/0199589 | A1* | 7/2018 | Seiler ..... | A23G 9/228 |

OTHER PUBLICATIONS

Written Opinion of the International Searching Authority regarding International Application No. PCT/US2015/045073, dated Oct. 28, 2015.

Extended European Search Report regarding Application No. 15832512.6 (PCT/US2015/045073) dated Jan. 26, 2018.

* cited by examiner

REFRIGERANT CHARGE DETECTION FOR ICE MACHINES

CROSS-REFERENCE TO RELATED APPLICATIONS

This application is a continuation of U.S. patent application Ser. No. 14/824,826 filed on Aug. 12, 2015. This application claims the benefit of U.S. Provisional Application No. 62/036,702, filed on Aug. 13, 2014. The entire disclosures of the above applications are incorporated herein by reference.

FIELD

The present disclosure relates to compressors, and more particularly, to a diagnostic system for use with a compressor.

BACKGROUND

This section provides background information related to the present disclosure and is not necessarily prior art.

Compressors are used in a wide variety of industrial and residential applications to circulate refrigerant within a refrigeration system, such as an ice machine, to provide a desired cooling effect. The compressor should provide consistent and efficient operation to ensure that the particular refrigeration system functions properly.

Refrigeration systems and associated compressors may include a protection system that selectively restricts power to the compressor to prevent operation of the compressor and associated components of the refrigeration system (i.e., evaporator, condenser, etc.) when conditions are unfavorable. The types of faults that may cause protection concerns include electrical, mechanical, and system faults. Electrical faults typically have a direct effect on an electrical motor associated with the compressor, while mechanical faults generally include faulty bearings or broken parts. Mechanical faults often raise a temperature of working components within the compressor and, thus, may cause malfunction of and possible damage to the compressor.

In addition to electrical and mechanical faults associated with the compressor, the compressor and refrigeration system components may be affected by system faults attributed to system conditions such as an adverse level of fluids (i.e., refrigerant) disposed within the system or a blocked-flow condition external to the compressor. Such system conditions may raise an internal compressor temperature or pressure to high levels, thereby damaging the compressor and causing system inefficiencies and/or failures.

Conventional protection systems typically sense temperature and/or pressure parameters as discrete switches and interrupt power supplied to the electrical motor of the compressor should a predetermined temperature or pressure threshold be exceeded. While such sensors provide an accurate indication of pressure or temperature within the refrigeration system and/or compressor, such sensors must be placed at numerous locations within the system and/or compressor, thereby increasing the complexity and cost of the refrigeration system and compressor.

Even when multiple sensors are employed, such sensors do not account for variability in manufacturing of the compressor or refrigeration system components. Furthermore, placement of such sensors within the refrigeration system are susceptible to changes in the volume of refrigerant disposed within the refrigeration system (i.e., change of the refrigeration system). Because such sensors are susceptible to changes in the volume of refrigerant disposed within the refrigeration system, such temperature and pressure sensors do not provide an accurate indication of temperature or pressure of the refrigerant when the refrigeration system and compressor experience a severe undercharge condition (i.e., a low-refrigerant condition) or a severe overcharge condition (i.e., a high-refrigerant condition).

SUMMARY

This section provides a general summary of the disclosure, and is not a comprehensive disclosure of its full scope or all of its features.

In one form, the present disclosure provides a system (e.g., for an ice machine) including a compressor driven by a motor. A condenser receives working fluid from the compressor. An evaporator is in fluid communication with the condenser and the compressor. A first sensor produces a first signal, and a second sensor produces a second signal. A processing circuitry processes the first signal and the second signal to determine a new baseline freeze time. The processing circuitry determines the new baseline freeze time for a predetermined time following an installation event, a service event, or a power outage of the compressor.

In some embodiments the first sensor produces the first signal which is indicative of one of current and power drawn by the motor.

In some embodiments, the second sensor produces the second signal which is indicative of a discharge line temperature.

In some embodiments, the processing circuitry processes the first signal and the second signal to determine a calculated freeze time.

In some embodiments, the processing circuitry compares the calculated freeze time to a stored, previously-generated, baseline freeze time.

In some embodiments, the processing circuitry determines whether a difference between the calculated freeze time and the baseline freeze time is less than a predetermined threshold.

In some embodiments, when the difference is less than the predetermined threshold and the calculated freeze time is different from the baseline freeze time, the processing circuitry averages the calculated freeze time with the baseline freeze time to generate a new baseline freeze time.

In some embodiments, the predetermined threshold is 20% greater than the baseline freeze time.

In some embodiments, when the difference is greater than the predetermined threshold, the processing circuitry determines a loss of charge condition based on the calculated freeze time, the first signal, and the second signal.

In some embodiments, the processing circuitry additionally utilizes one or more of a condenser temperature, a condenser subcooling, a compressor superheat, an ambient air temperature, and a water inlet temperature to determine the loss of charge condition.

In some embodiments, a third sensor produces a third signal indicative of evaporator temperature, and a fourth sensor produces a fourth signal indicative of liquid line temperature. The processing circuitry processes the second signal and the third signal to determine a calculated compressor superheat temperature and processes the first signal, the third signal, and the fourth signal to determine a calculated condenser subcooling temperature.

In some embodiments, the processing circuitry compares one or more of the calculated freeze time, the calculated compressor superheat temperature, and the calculated condenser subcooling temperature, to a stored, previously-generated, baseline freeze time, baseline compressor super heat temperature, and baseline condenser subcooling temperature, respectively.

In some embodiments, the processing circuitry determines whether a difference between one or more of the calculated freeze time, the calculated compressor superheat temperature, and the calculated condenser subcooling temperature, and the stored, previously-generated, baseline freeze time, baseline compressor super heat temperature, and baseline condenser subcooling temperature, respectively, is less than a predetermined threshold.

In some embodiments, when the difference is less than the predetermined threshold, the processing circuitry averages the one or more of the calculated freeze time, the calculated compressor superheat temperature, and the calculated condenser subcooling temperature with the baseline freeze time, baseline compressor super heat temperature, and baseline condenser subcooling temperature, respectively, to generate a new baseline value.

In some embodiments, when the difference is greater than the predetermined threshold, the processing circuitry determines a loss of charge condition based on the calculated freeze time, the first signal, and the second signal.

In some embodiments, the processing circuitry additionally utilizes one or more of a condenser temperature, the calculated condenser subcooling temperature, the calculated compressor superheat temperature, an ambient air temperature, and a water inlet temperature to determine the loss of charge condition.

In some embodiments, the predetermined time is fourteen days.

In another form, the present disclosure provides a method including detecting, by a first sensor, a first signal; detecting, by a second sensor, a second signal; processing, by a processing circuitry, the first signal and the second signal; and determining, by a processing circuitry a new baseline freeze time from the first signal and the second signal. The new baseline freeze time is determined for a predetermined time following an installation event, a service event, or a power outage of a compressor.

In some embodiments, the method further includes producing, by the first sensor, the first signal which is indicative of one of current and power drawn by a motor of the compressor; and producing, by the second sensor, the second signal which is indicative of a discharge line temperature.

In some embodiments, the method further includes processing, by the processing circuitry, the first signal and the second signal to determine a calculated freeze time.

In some embodiments, the method further includes comparing, by the processing circuitry, the calculated freeze time to a stored, previously-generated, baseline freeze time.

In some embodiments, the method further includes determining, by the processing circuitry, whether a difference between the calculated freeze time and the baseline freeze time is less than a predetermined threshold.

In some embodiments, the method further includes averaging, by the processing circuitry, the calculated freeze time with the baseline freeze time to generate a new baseline freeze time when the difference is less than the predetermined threshold and the calculated freeze time is different from the baseline freeze time.

In some embodiments, the predetermined threshold is 20% greater than the baseline freeze time.

In some embodiments, the method further includes determining, by the processing circuitry, a loss of charge condition based on the calculated freeze time, the first signal, and the second signal when the difference is greater than the predetermined threshold.

In some embodiments, the method further includes determining, by the processing circuitry, the loss of charge condition by additionally utilizing one or more of a condenser temperature, a condenser subcooling temperature, a compressor superheat temperature, an ambient air temperature, and a water inlet temperature.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
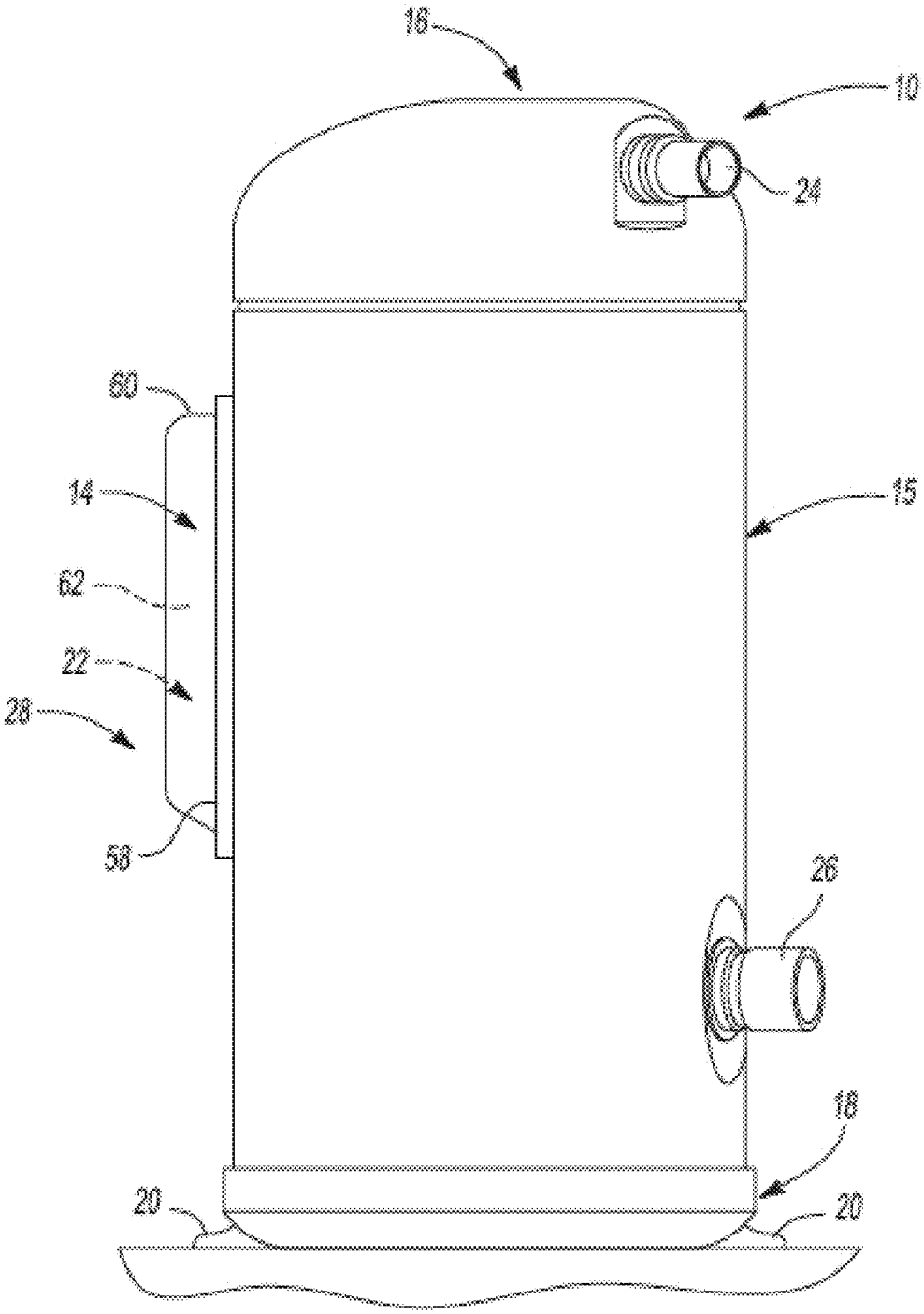
FIG. 1 is a perspective view of a compressor incorporating a protection and control system in accordance with the principles of the present teachings.

Example embodiments will now be described more fully with reference to the accompanying drawings. The following description is merely exemplary in nature and is not intended to limit the present disclosure, application, or uses. It should be understood that throughout the drawings, corresponding reference numerals indicate like or corresponding parts and features.

With reference to the drawings, a compressor 10 is shown incorporated into a refrigeration system 12. While a scroll compressor is illustrated and described in the system, the disclosure applies to any compressor technology, including, for example, scroll compressors, reciprocating compressors, screw compressors, and rotary compressors. The refrigeration system 12 could be or be a part of an ice machine, for example, or any other cooling system. A protection and control system 14 is associated with the compressor 10 and the refrigeration system 12 to monitor, control, protect, and/or diagnose the compressor 10 and/or the refrigeration system 12. The protection and control system 14 utilizes a series of sensors to determine non-measured operating parameters of the compressor 10 and/or refrigeration system 12 and uses the non-measured operating parameters in conjunction with measured operating parameters from the sensors to monitor, control, protect, and/or diagnose a refrigerant charge level of the refrigeration system 12. Such non-measured operating parameters may also be used to check the sensors to validate the measured operating parameters.

Figure 2:
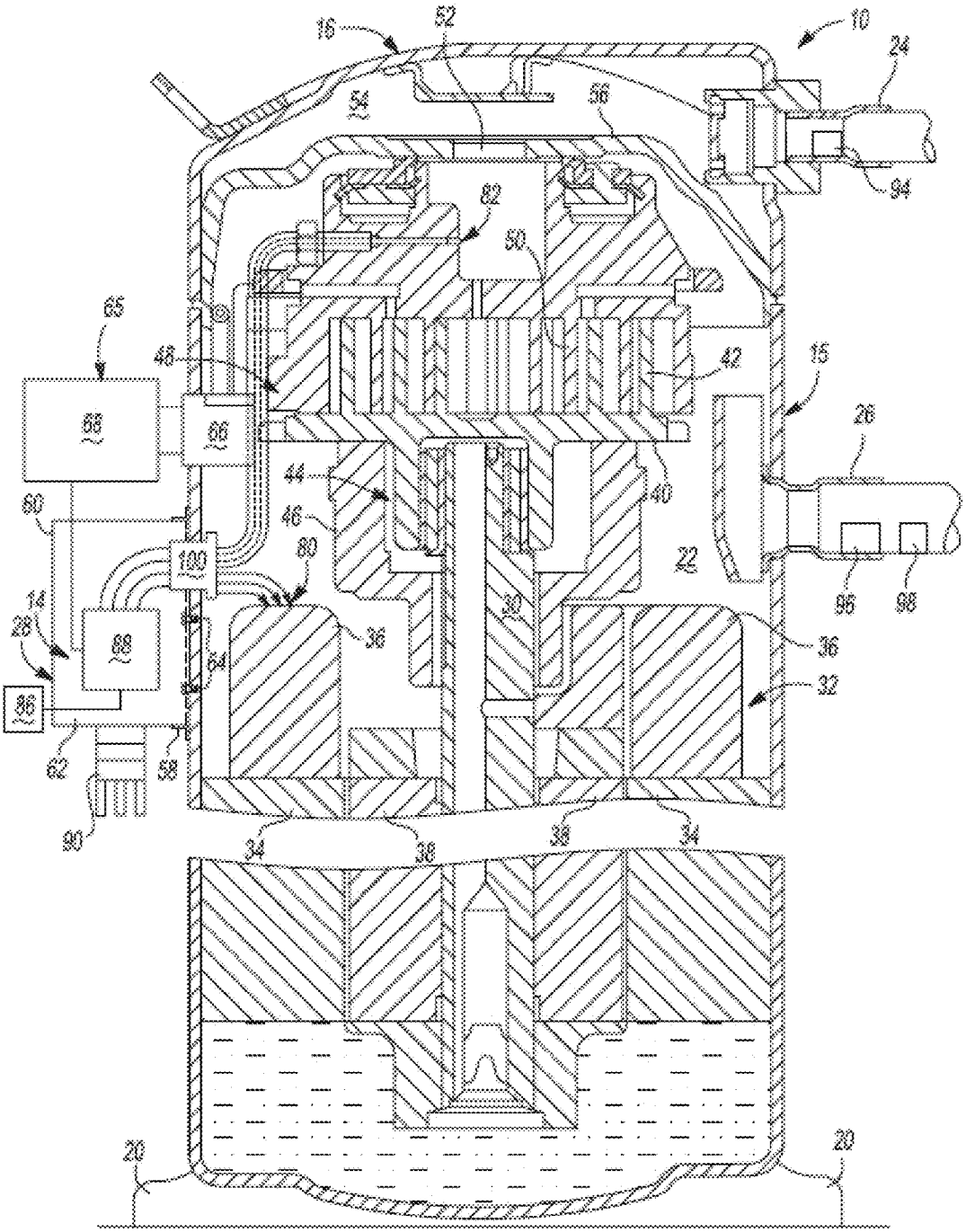
FIG. 2 is a cross-sectional view of the compressor of FIG. 1.

With particular reference to FIGS. 1 and 2, the compressor 10 is shown to include a generally cylindrical hermetic shell 15 having a welded cap 16 at a top portion and a base 18 having a plurality of feet 20 welded at a bottom portion. The cap 16 and the base 18 are fitted to the shell 15 such that an interior volume 22 of the compressor 10 is defined. The cap 16 is provided with a discharge fitting 24, while the shell 15 is similarly provided with an inlet fitting 26, disposed generally between the cap 16 and base 18, as best shown in FIG. 2. An electrical enclosure 28 is attached to the shell 15 generally between the cap 16 and the base 18 and may support a portion of the protection and control system 14 therein.

A crankshaft 30 is rotatably driven by an electric motor 32 relative to the shell 15. The motor 32 includes a stator 34 fixedly supported by the hermetic shell 15, windings 36 passing there through, and a rotor 38 press-fit on the crankshaft 30. The motor 32 and associated stator 34, windings 36, and rotor 38 cooperate to drive the crankshaft 30 relative to the shell 15 to compress a fluid.

The compressor 10 may include an orbiting scroll member 40 having a spiral vane or wrap 42 on an upper surface thereof for use in receiving and compressing a fluid. An Oldham coupling 44 is disposed generally between the orbiting scroll member 40 and a bearing housing 46 and is keyed to the orbiting scroll member 40 and a non-orbiting scroll member 48. The Oldham coupling 44 transmits driving forces from the crankshaft 30 to the orbiting scroll member 40 to move the orbiting scroll member 40 along an orbital path (while preventing rotation of the orbiting scroll member 40) to compress a fluid disposed generally between the orbiting scroll member 40 and the non-orbiting scroll member 48.

The non-orbiting scroll member 48 can be supported by the bearing housing 46 and includes a spiral wrap 50 positioned in meshing engagement with the wrap 42 of the orbiting scroll member 40. The non-orbiting scroll member 48 has a centrally disposed discharge passage 52, which communicates with an upwardly open recess 54. The recess 54 is in fluid communication with the discharge fitting 24 defined by the cap 16 and a partition 56, such that compressed fluid exits the shell 15 via discharge passage 52, recess 54, and fitting 24.

The electrical enclosure 28 may include a first housing member 58, a second housing member 60, and a cavity 62. The first housing member 58 may be mounted to the shell 15 using a plurality of studs 64, which are welded or otherwise fixedly attached to the shell 15. The second housing member 60 may be matingly received by the lower housing 58 and defines the cavity 62 therebetween. The cavity 62 is positioned on the shell 15 of the compressor 10 and may be used to house respective components of the protection and control system 14 and/or other hardware used to control operation of the compressor 10 and/or refrigeration system 12.

With particular reference to FIG. 2, the compressor 10 may include an actuation assembly 65 that selectively separates the orbiting scroll member 40 from the non-orbiting scroll member 48 to modulate a capacity of the compressor 10 between a reduced-capacity mode and a full-capacity mode. The actuation assembly 65 may include a solenoid 66 connected to the orbiting scroll member 40 and a controller 68 coupled to the solenoid 66 for controlling movement of the solenoid 66 between an extended position and a retracted position.

Movement of the solenoid 66 into the extended position separates the wraps 42 of the orbiting scroll member 40 from the wraps 50 of the non-orbiting scroll member 48 to reduce an output of the compressor 10. Conversely, movement of the solenoid 66 into the retracted position moves the wraps 42 of the orbiting scroll member 40 closer to the wraps 50 of the non-orbiting scroll member 48 to increase an output of the compressor. In this manner, the capacity of the compressor 10 may be modulated in accordance with demand or in response to a fault condition. While movement of the solenoid 66 into the extended position is described as separating the wraps 42 of the orbiting scroll member 40 from the wraps 50 of the non-orbiting scroll member 48, movement of the solenoid 66 into the extended position could alternately move the wraps 42 of the orbiting scroll member 40 into engagement with the wraps 50 of the non-orbiting scroll member 48. Similarly, while movement of the solenoid 66 into the retracted position is described as moving the wraps 42 of the orbiting scroll member 40 closer to the wraps 50 of the non-orbiting scroll member 48, movement of the solenoid 66 into the retracted position could alternately move the wraps 42 of the orbiting scroll member 40 away from the wraps 50 of the non-orbiting scroll member 48.

Figure 3:
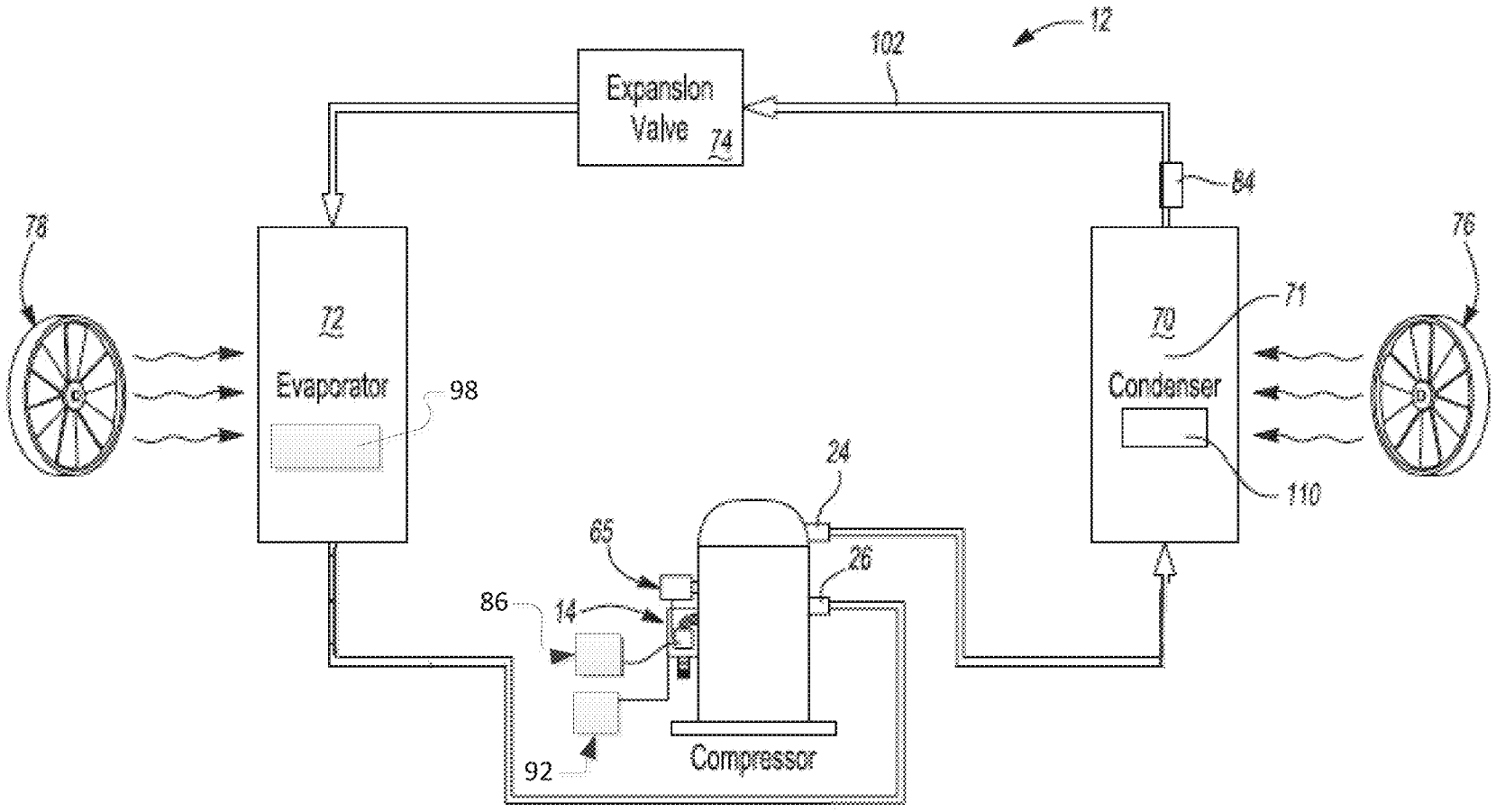
FIG. 3 is a schematic representation of a refrigeration system incorporating the compressor of FIG. 1.

With particular reference to FIG. 3, the refrigeration system 12 is shown to include the compressor 10, a condenser 70, an evaporator 72, and an expansion device 74 disposed generally between the condenser 70 and the evaporator 72. The refrigeration system 12 may also include a condenser fan 76 associated with the condenser 70 and an evaporator fan 78 associated with the evaporator 72. Each of the condenser fan 76 and the evaporator fan 78 may be variable-speed fans that can be controlled based on a cooling demand of the refrigeration system 12. Furthermore, each of the condenser fan 76 and evaporator fan 78 may be controlled by the protection and control system 14 such that operation of the condenser fan 76 and evaporator fan 78 may be coordinated with operation of the compressor 10.

In operation, the compressor 10 circulates refrigerant generally between the condenser 70 and evaporator 72 to produce a desired cooling effect. The compressor 10 receives vapor refrigerant from the evaporator 72 generally at the inlet fitting 26 and compresses the vapor refrigerant between the orbiting scroll member 40 and the non-orbiting scroll member 48 to deliver vapor refrigerant at discharge pressure at discharge fitting 24.

Once the compressor 10 has sufficiently compressed the vapor refrigerant to discharge pressure, the discharge-pressure refrigerant exits the compressor 10 at the discharge fitting 24 and travels within the refrigeration system 12 to the condenser 70. Once the vapor enters the condenser 70, the refrigerant changes phase from a vapor to a liquid, thereby rejecting heat. The rejected heat is removed from the condenser 70 through circulation of air through the condenser 70 by the condenser fan 76. When the refrigerant has sufficiently changed phase from a vapor to a liquid, the refrigerant exits the condenser 70 and travels within the refrigeration system 12 generally towards the expansion device 74 and evaporator 72.

Upon exiting the condenser 70, the refrigerant first encounters the expansion device 74. Once the expansion device 74 has sufficiently expanded the liquid refrigerant, the liquid refrigerant enters the evaporator 72 to change phase from a liquid to a vapor. Once disposed within the evaporator 72, the liquid refrigerant absorbs heat, thereby changing from a liquid to a vapor and producing a cooling effect. Once the refrigerant has sufficiently changed phase from a liquid to a vapor, the vaporized refrigerant is received by the inlet fitting 26 of the compressor 10 to begin the cycle anew.

With particular reference to FIGS. 2 and 3, the protection and control system 14 is shown to include a high-side sensor 80, a low-side sensor 82, a liquid-line temperature sensor 84, and an outdoor/ambient temperature sensor 86. The protection and control system 14 also includes processing circuitry, or a control module, 88 and a power-interruption system 90, each of which may be disposed within the electrical enclosure 28 mounted to the shell 15 of the compressor 10. The sensors 80, 82, 84, 86 cooperate with a water inlet temperature sensor 92 to provide the control module 88 with sensor data for use by the control module 88 in determining non-measured operating parameters of the compressor 10 and/or refrigeration system 12. The control module 88 uses the sensor data and the determined non-measured operating parameters to determine a refrigerant charge level of the refrigeration system 12 and selectively displays a warning, sounds an alarm, and/or restricts power to the electric motor of the compressor 10 via the power-interruption system 90, depending on the refrigerant charge level.

The high-side sensor 80 generally provides diagnostics related to high-side faults such as compressor mechanical failures, motor failures, and electrical component failures such as missing phase, reverse phase, motor winding current imbalance, open circuit, low voltage, locked rotor current, excessive motor winding temperature, welded or open contactors, and short cycling. The high-side sensor 80 may be a current sensor that monitors compressor current and voltage. The high-side sensor 80 may be mounted within the electrical enclosure 28 or may alternatively be incorporated inside the shell 15 of the compressor 10 (FIG. 2). In either case, the high-side sensor 80 monitors current drawn by the compressor 10 and generates a signal indicative thereof.

The low-side sensor 82 generally provides diagnostics related to low-side faults such as a low charge in the refrigerant, a plugged orifice, an evaporator fan failure, or a leak in the compressor 10. The low-side sensor 82 may be disposed proximate to the discharge fitting 24 or the discharge passage 52 of the compressor 10 and monitors a discharge-line temperature of a compressed fluid exiting the compressor 10. In addition to the foregoing, the low-side sensor 82 may be disposed external from the compressor shell 15 and proximate to the discharge fitting 24 such that vapor at discharge pressure encounters the low-side sensor 82. Locating the low-side sensor 82 external of the shell 15 allows flexibility in compressor and system design by providing the low-side sensor 82 with the ability to be readily adapted for use with practically any compressor and any system.

While the low-side sensor 82 may be positioned external to the shell 15 of the compressor 10, the discharge temperature of the compressor 10 can similarly be measured within the shell 15 of the compressor 10. A discharge core temperature, taken generally at the discharge fitting 24, could be used in place of the discharge-line temperature arrangement shown in FIG. 2.

The liquid-line temperature sensor 84 may be positioned either within the condenser 70 proximate to an outlet of the condenser 70 or positioned along a conduit 102 extending generally between an outlet of the condenser 70 and the expansion device 74. Because the liquid-line temperature sensor 84 is disposed generally near an outlet of the condenser 70 or along the conduit 102 extending generally between the outlet of the condenser 70 and the expansion device 74, the liquid-line temperature sensor 84 encounters liquid refrigerant (i.e., after the refrigerant has changed from a vapor to a liquid within the condenser 70) and provides an indication of a temperature of the liquid refrigerant to the control module 88. While the liquid-line temperature sensor 84 is described as being near an outlet of the condenser 70 or along a conduit 102 extending between the condenser 70 and the expansion device 74, the liquid-line temperature sensor 84 may also be placed anywhere within the refrigeration system 12 that would allow the liquid-line temperature sensor 84 to provide an indication of a temperature of liquid refrigerant within the refrigeration system 12 to the control module 88.

The ambient temperature sensor or outdoor/ambient temperature sensor 86 may be located external from the compressor shell 15 and generally provides an indication of the outdoor/ambient temperature surrounding the compressor 10 and/or refrigeration system 12. The outdoor/ambient temperature sensor 86 may be positioned adjacent to the compressor shell 15 such that the outdoor/ambient temperature sensor 86 is in close proximity to the control module 88 (FIG. 2). Placing the outdoor/ambient temperature sensor 86 in close proximity to the compressor shell 15 provides the control module 88 with a measure of the temperature generally adjacent to the compressor 10. Locating the outdoor/ambient temperature sensor 86 in close proximity to the compressor shell 15 not only provides the control module 88 with an accurate measure of the surrounding air around the compressor 10, but also allows the outdoor/ambient temperature sensor 86 to be attached to or within the electrical enclosure 28.

The water inlet temperature sensor 92 may be located external from the compressor shell 15 and at a water inlet to the ice machine. The water inlet temperature sensor 92 generally provides an indication of the temperature of the water entering the ice machine. Locating the water inlet temperature sensor 92 at the water inlet to the ice machine provides the control module 88 with an accurate measure of the water temperature entering the ice machine.

Figure 4:
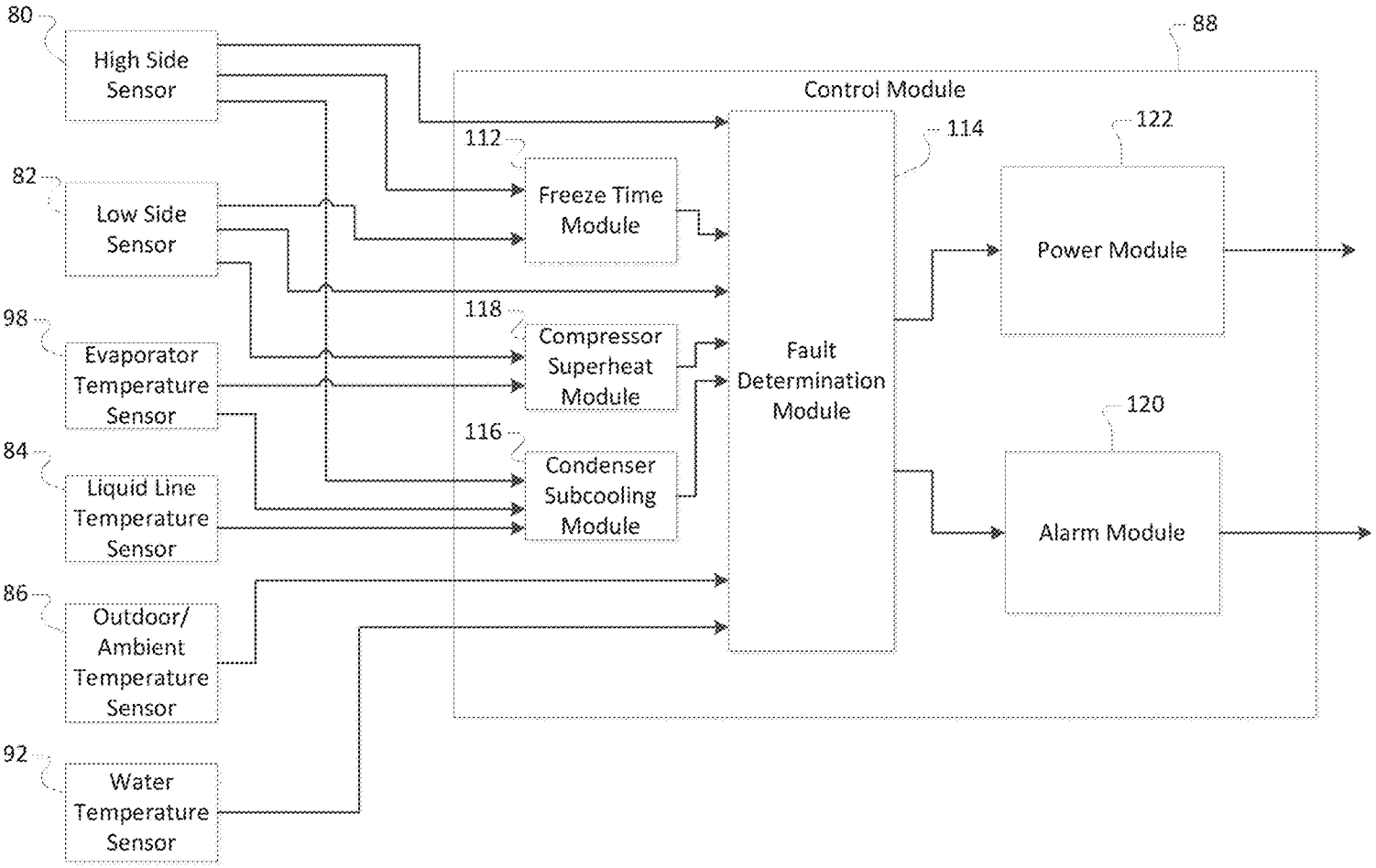
FIG. 4 is a block diagram of a control system for the compressor of FIG. 1.

Now referring to FIG. 4, the control module 88 receives sensor data from the high-side sensor 80, low-side sensor 82, liquid-line temperature sensor 84, outdoor/ambient temperature sensor 86, water inlet temperature sensor 92, and, optionally, a condenser temperature sensor 110 for use in controlling and diagnosing the compressor 10 and/or refrigeration system 12. The control module 88 may additionally use the sensor data from the respective sensors 80, 82, 84, 86, 92, 110 to determine non-measured operating parameters of the compressor 10 and/or refrigeration system 12 using known relationships between the sensor data and the non-measured operating parameters.

The control module 88 determines the non-measured operating parameters of the compressor 10 and/or refrigeration system 12 based on the sensor data received from the respective sensors 80, 82, 84, 86, 92, 110 without requiring individual sensors for each of the non-measured operating parameters. The control module 88 is able to determine a subcooling temperature of the refrigeration system 12 and a compressor superheat of the refrigeration system 12. The control module 88 further determines a freeze cycle and a harvest cycle of the refrigeration system 12. An exemplary freeze/harvest cycle is illustrated in FIG. 7.

The freeze cycle is a time period during which ice is formed within the ice machine, and the harvest cycle is a time period during which the ice is deployed, or "harvested," from the ice machine. The freeze cycle can be detected when the high side sensor 80 detects a change in compressor current and the low side sensor 82 detects a change in the discharge line temperature. The change in current and discharge line temperature is a result of the compressor 10 ceasing operation to allow the harvest cycle to occur. Therefore, sensors 80, 82, in combination with control module, or processing circuitry, 88, are able to detect the freeze cycle and harvest cycle during compressor start-up, quasi steady-state, and steady-state operating conditions.

Figure 7:
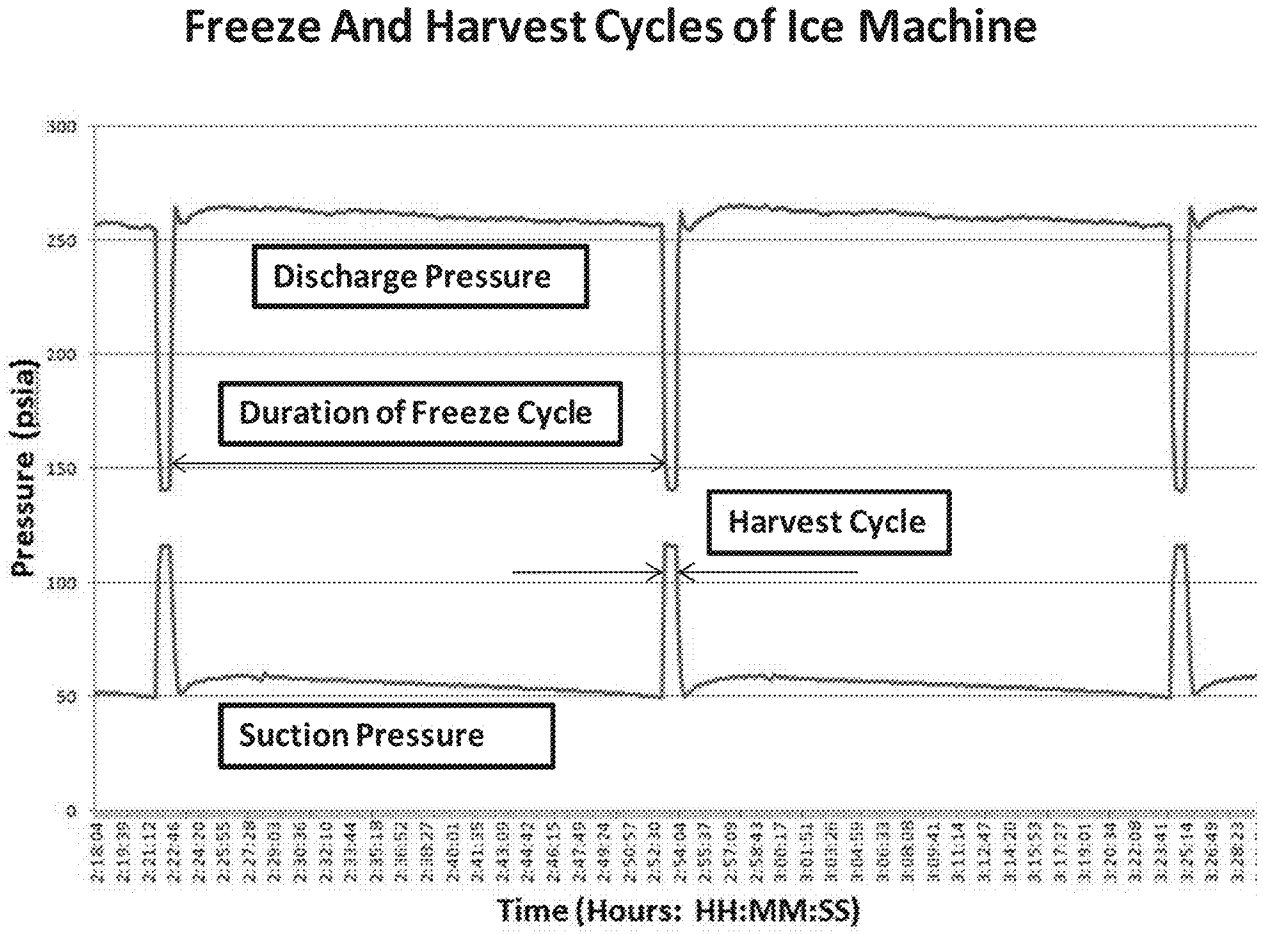
FIG. 7 is a graph of freeze and harvest cycles of an exemplary ice machine for use in determining a change in duration of the freeze cycle.

The control module 88 can also detect the freeze cycle from a change in discharge pressure and suction pressure as illustrated in FIG. 7. During the freeze cycle, the discharge pressure is high while the suction pressure is low, as will be described in more detail in relation to FIG. 7, below. During the harvest cycle, the discharge pressure is low while the suction pressure is high, as will be described in more detail in relation to FIG. 7, below.

The condenser temperature may either be determined from the condenser sensor 110 mounted on a coil of the condenser 70 or be derived from the compressor current. The condenser temperature may be determined by referencing compressor power on a compressor map. The compressor map illustrates compressor current versus condenser temperature at various evaporator temperatures. The derived condenser temperature is generally the saturated condenser temperature equivalent to the discharge pressure for a particular refrigerant and should be close to a temperature at a mid-point of the condenser 70. The evaporator temperature may then be determined from the derived condenser temperature.

Once the condenser temperature is either derived or determined from the sensor 110, the control module 88 is then able to determine the subcooling of the refrigeration system 12 by subtracting the liquid-line temperature, as indicated by the liquid-line temperature sensor 84, from the condenser temperature and then subtracting an additional small value (2-3° Fahrenheit, for example) representing the pressure drop between an outlet of the compressor 10 and an outlet of the condenser 70. The control module 88 is therefore capable of determining not only the condenser temperature but also the subcooling of the refrigeration system 12 without requiring an additional temperature sensor for either operating parameter.

While the above method determines a temperature of the condenser 70 without requiring an additional temperature sensor, the above method may be slightly inaccurate. As such, use of the condenser temperature sensor 110 disposed generally at a midpoint of a coil 71 of the condenser 70 may be used in conjunction with the derived condenser temperature to determine the actual temperature of the condenser 70. The actual temperature of the condenser 70 is defined as the saturated temperature or saturated pressure of the refrigerant disposed within the condenser 70 generally at a midpoint of the condenser 70 (i.e., when refrigerant disposed within the condenser 70 is at a substantially 50/50 vapor/liquid mixture).

Discharge line temperature data and current data can be used to determine superheat. The condenser temperature may be derived from the compressor current or determined from the condenser temperature sensor 110 as previously discussed. Superheat is generally referred to as the difference between suction line temperature and evaporator temperature.

Further referring to FIG. 4, a plurality of sensors provide input signals to the control module 88, such as high side sensor 80, low side sensor 82, ambient air temperature sensor 86, water inlet temperature sensor 92, and condenser temperature sensor 110. A freeze time module 112 receives compressor current information from the high side sensor 80 and discharge line temperature information from the low side sensor 82 and determines whether the compressor 10 is in a freeze cycle or a harvest cycle. The freeze time module tracks the time that the compressor 10 stays in the freeze cycle and outputs a freeze time to a fault determination module 114.

A condenser subcooling module 116 receives compressor current information from the high side sensor 80, condenser temperature information from either the temperature sensor 110 or a condenser temperature determination module (not shown), and liquid line temperature information from the liquid line temperature sensor 84. The condenser subcooling module 116 calculates the condenser subcooling temperature using the method previously described and outputs the condenser subcooling temperature to the fault determination module 114.

A compressor superheat module 118 receives suction line temperature information from the low side sensor 82 and evaporator temperature information from the temperature sensor 98. The compressor superheat module 118 calculates the compressor superheat using the method previously described and outputs the compressor superheat temperature to the fault determination module 114.

The fault determination module 114 receives freeze time from the freeze time module 112, condenser subcooling temperatures from the condenser subcooling module 116, compressor superheat temperatures from the compressor superheat module 118, compressor current from the high side sensor 80, discharge line temperature from the low side sensor 82, ambient air temperature from the outdoor/ambient temperature sensor 86, water inlet temperature from the water inlet temperature sensor 92, and, optionally, condenser temperature from the condenser temperature sensor 110. The fault determination module 114 compares these operating parameters to baseline data (illustrated in FIGS. 7-12) and determines whether there has been a loss of charge event which will be described in further detail below.

The baseline data is determined in the factory to determine "normal" or no-fault operating conditions and fault conditions for the compressor 10 and system 12. The baseline data is determined in a controlled ambient temperature, and for a variety of different controlled ambient temperatures, for example only, at 35, 70, 90, 110 degrees Fahrenheit (° F.), using a consistent water temperature, and for a variety of different consistent water temperatures, for example only, at 40, 50, 70, and 97° F., and over multiple compressor cycles.

Once installed in the field, and after service or a power outage, the system 12 may perform a self-learning function. The self-learning function provides more accurate baseline data than the baseline data generated in the factory and leads to more reliable fault detection and fewer false failures. The self-learning function may run for a predetermined or calibratable time period. A calibratable value is a value that is capable of being calibrated or determined in advance of installation and can be set to any reasonable number as determined by the refrigeration expert. For example only, the self-learning function my run for fourteen (14) days from an initial installation, a service event, or a power outage. During execution of the self-learning function, the sensors 80, 82, 84, 86, 92 measure the system parameters. The freeze time module 112, the compressor superheat module 118, and the condenser subcooling module 116 determine the freeze time, the compressor superheat temperature, and the condenser subcooling temperature, respectively. The fault determination module 114 compares one or more of the freeze time, the compressor superheat temperature, the condenser subcooling temperature, and the remaining measured system parameters to the baseline data generated at the factory.

If the fault determination module 114 determines that one or more of the measured system parameters is less than a calibratable threshold (for example only, 20%—this value may be system parameter specific) different than the baseline value for that parameter, the fault determination module 114 averages the measured temperature with the baseline value to generate a new baseline value. The self-learning feature runs for the calibratable number of days to provide the system 12 with a robust set of baseline data to use in determining loss of refrigerant charge faults.

After the self-learning function is complete or if one or more of the measured system parameters is greater than the calibratable threshold (for example, 20%), the fault determination module 114 diagnoses the system 12 for loss of refrigerant charge. In an example embodiment, the fault determination module 114 determines loss of refrigerant charge based on the measured, or determined, freeze time. If the freeze time is greater than a first threshold (for example only, 20% greater than the baseline freeze time), the compressor current is less than the baseline compressor current, and the discharge temperature is greater than the baseline discharge temperature, the fault determination module 114 determines that there is a loss of refrigerant charge. The amount of refrigerant charge loss may be determined using the charts in FIGS. 8-10 which will be described in further detail later. Upon a loss of charge condition determination, the fault determination module 114 may communicate a signal to an alarm module 120. If the fault determination module 114 determines that the freeze time is greater than a second threshold (for example only, 35% greater than the baseline freeze time), the fault determination module 114 may communicate a signal to a power module 122.

In other embodiments, additional parameters such as compressor current, discharge temperature, condenser temperature, condenser subcooling, compressor superheat, ambient air temperature, and water inlet temperature may be used, either instead of or in addition to freeze time, to monitor the change in refrigerant charge and to make the charge detection algorithm more robust. Examples of changes in the parameters' indications on refrigerant charge level are illustrated in FIGS. 8-12 and will be described in further detail below.

The alarm module 120 receives signals from the fault determination module 114 if a loss of refrigerant charge condition is determined. The alarm module 120 determines the appropriate path to follow based on the level of loss of refrigerant charge communicated by the fault determination module 114. The system 12 may contain one or more of a display screen (not illustrated) or an alarm system (not illustrated) to indicate faults or failures in the system 12. The alarm module 120 may indicate the loss of charge condition on the display screen if the loss of charge is within a first calibratable range (for example only, between 0% and 30% loss of charge). The alarm module may, in addition to, or instead of, the display, activate an alarm if the loss of charge is within a second calibratable range (for example only, between 30% and 35% loss of charge).

The power module 122 receives signals from the fault determination module 114 if a loss of refrigerant charge condition is determined. The power module 122 may activate a shut off procedure within the power interruption system 90 to shut power down to the system 12 if the loss of charge is within a third calibratable range (for example only, between 35% and 100% loss of charge). The power module 122 may activate the power interruption system 90, shutting power down to the system 12 to prevent additional mechanical and/or electrical failures that could occur during a significant loss of refrigerant charge.

Figure 5:
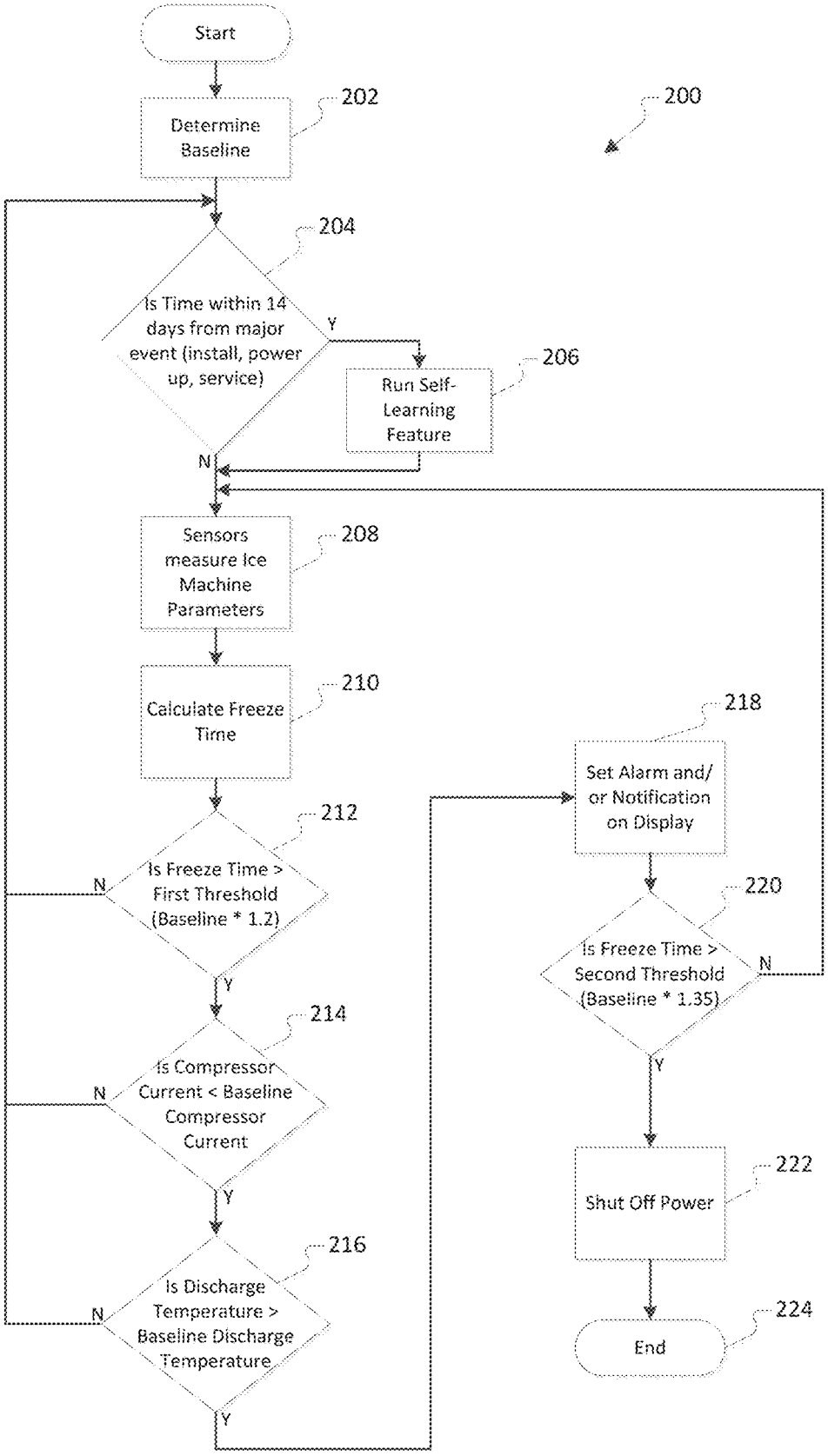
FIG. 5 is a flow chart of a method for monitoring diagnostics of the compressor of FIG. 1.

Now referring to FIG. 5, a method 200 for monitoring diagnostics of the compressor 10 is illustrated. Baseline data (illustrated in FIGS. 7-12) is determined at step 202. The baseline data is determined in the factory to determine "normal" or no-fault operating conditions and fault conditions for the compressor 10 and system 12. The baseline data is determined in a controlled ambient temperature, and for a variety of different controlled ambient temperatures, for example only, at 35, 70, 90, 110 degrees ° F., using a consistent water temperature, and for a variety of different consistent water temperatures, for example only, at 40, 50, 70, and 97° F., and over multiple compressor cycles.

At step 204, method 200 determines whether the current time is within the calibratable time period (for example only, fourteen days) from an initial installation, a service event, or a power outage. If true, the method 200 runs the self-learning feature at step 206. If false at step 204, the sensors 80, 82, 84, 86, 92, 110 measure the system parameters at step 208.

At step 210, the freeze time, the compressor superheat temperature, and the condenser subcooling temperature are determined from the sensor 80, 82, 84, 86, 92, 110 data. For purposes of method 200, only the determination of refrigerant charge level with respect to the freeze time, compressor current, and discharge temperature will be discussed. However, it is understood that additional parameters such as compressor current, discharge temperature, condenser temperature, condenser subcooling, compressor superheat, ambient air temperature, and water inlet temperature may be used, either instead of or in addition to freeze time, to monitor the change in refrigerant charge and to make the charge detection algorithm more robust.

The freeze time is the time that the compressor 10 stays in the freeze cycle and, as previously discussed, can be determined from the high side sensor 80 and discharge line temperature information from the low side sensor 82. At 212, method 200 determines whether the freeze time is greater than a first threshold (for example only, 1.2 times the baseline freeze time). If false, the method 200 returns to step 204 to determine whether the current time is within the calibratable time period (for example only, fourteen days) from an initial installation, a service event, or a power outage.

If true at step 212, the method 200 determines whether the compressor current is less than the baseline compressor current at step 214. If false, the method 200 returns to step 204 to determine whether the current time is within the calibratable time period (for example only, fourteen days) from an initial installation, a service event, or a power outage.

If true at step 214, the method 200 determines whether the discharge temperature is greater than the baseline discharge temperature at step 216. If false, the method 200 returns to step 204 to determine whether the current time is within the calibratable time period (for example only, fourteen days) from an initial installation, a service event, or a power outage.

If true at step 216, the method 200 sets an alarm and/or sends a notification to a display screen at step 218. If only one of an alarm or display screen is present in the system 12, the method 200 may set that alarm or send that notification. If both an alarm and a display screen are present in the system, the method 200 may progress to different types of notification based on the amount of refrigerant charge loss. For example, the alarm module 120 may indicate the loss of charge condition on the display screen if the loss of charge is within a first calibratable range (for example only, between 0% and 30% loss of charge). The alarm module may, in addition to, or instead of, the display, activate an alarm if the loss of charge is within a second calibratable range (for example only, between 30% and 35% loss of charge).

At step 220, the method 200 determines whether the freeze time is greater than a second threshold (for example only, 1.35 times the baseline freeze time). If false, the method 200 returns to step 208 and the sensors 80, 82, 84, 86, 92, 110 measure the system parameters. If true at step 220, the method activates the power interruption system 90, shutting off power to the system 12 at step 222. The method 200 ends at step 224.

Figure 6:
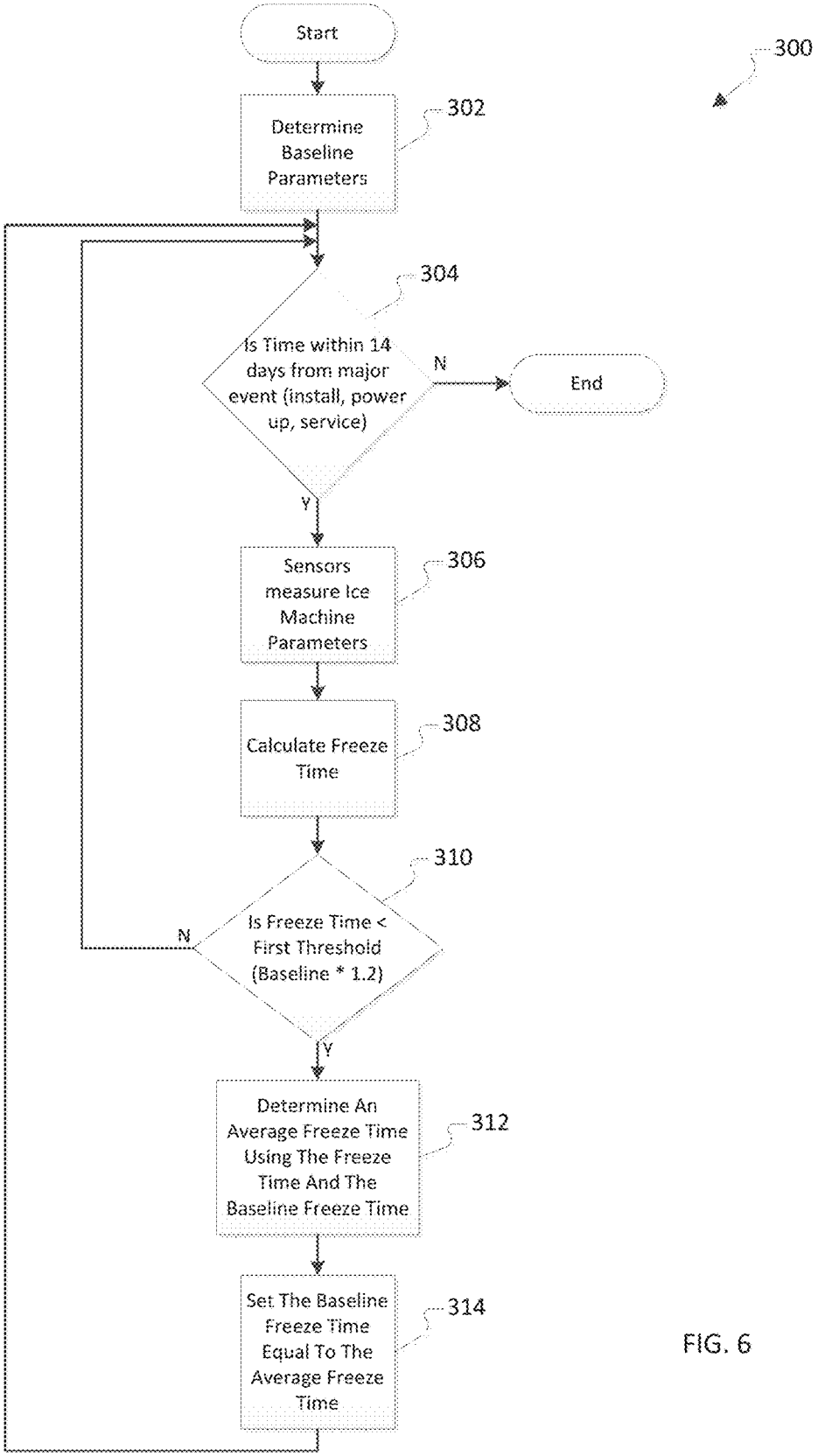
FIG. 6 is a flow chart of a method of self-learning for the compressor of FIG. 1.

Now referring to FIG. 6, a method 300 of self-learning for the compressor 10 is illustrated. Baseline data (illustrated in FIGS. 7-12) is determined at step 302. The baseline data is determined in the factory to determine "normal" or no-fault operating conditions and fault conditions for the compressor 10 and system 12. The baseline data is determined in a controlled ambient temperature, and for a variety of different controlled ambient temperatures, for example only, at 35, 70, 90, 110 degrees ° F., using a consistent water temperature, and for a variety of different consistent water temperatures, for example only, at 40, 50, 70, and 97° F., and over multiple compressor cycles.

At step 304, method 300 determines whether the current time is within the calibratable time period (for example only, fourteen days) from an initial installation, a service event, or a power outage. If false, the method 300 ends. If true at step 304, the sensors 80, 82, 84, 86, 92, 110 measure the system parameters at step 306.

At step 308, the freeze time, the compressor superheat temperature, and the condenser subcooling temperature are determined from the sensor 80, 82, 84, 86, 92, 110 data. For purposes of method 300, only the determination of refrigerant charge level with respect to the freeze time, compressor current, and discharge temperature will be discussed. However, it is understood that additional parameters such as compressor current, discharge temperature, condenser temperature, condenser subcooling, compressor superheat, ambient air temperature, and water inlet temperature may be used, either instead of or in addition to freeze time, to monitor the change in refrigerant charge and to make the charge detection algorithm more robust.

The freeze time is the time that the compressor 10 stays in the freeze cycle and, as previously discussed, can be determined from the high side sensor 80 and discharge line temperature information from the low side sensor 82. At step 310, method 300 determines whether the freeze time is less than a first threshold (for example only, 1.2 times the baseline freeze time). If false, the method 300 returns to step 304 to determine whether the current time is within the calibratable time period from the initial installation, service event, or power outage.

If true at step 310, the method 300 determines an average freeze time using the current freeze time and the baseline freeze time at step 312. The method 300 sets the baseline freeze time equal to the average freeze time at step 314 and returns to step 304 to determine whether the current time is within the calibratable time period from the initial installation, service event, or power outage. The method 300 continues until the current time is no longer within the calibratable time period from the initial installation, service event, or power outage.

Now referring to FIG. 7, a chart illustrating typical freeze and harvest cycles of an ice machine is depicted. The freeze cycle is characterized by increased discharge pressure and decreased suction pressure in the compressor 10 over a time period. For example only, during the freeze cycle the discharge pressure may be within a general range of 250-300 pounds per square inch absolute (psia) and the suction pressure may be within a general range of 50-75 psia. The freeze cycle is the time during which ice is formed in trays in the ice machine. During the freeze cycle, the fluid is routed from the compressor 10 to the condenser 70 to the expansion device 74 and then the evaporator 72 as described previously in relation to FIG. 3.

Once ice has been formed, the compressor 10 cycles through a harvest cycle where the ice is removed from the trays. During the harvest cycle, the discharge fluid is routed from the compressor 10 to the evaporator 72, bypassing the condenser 70. The ice falls from the trays in which it was formed onto a physical divider and breaks. The harvest cycle is characterized as a decrease in the discharge pressure and an increase in the suction pressure in the compressor. For example only, during the harvest cycle the discharge pressure may be within a general range of 140-160 psia and the suction pressure may be within a general range of 115-135 psia.

Figure 8:
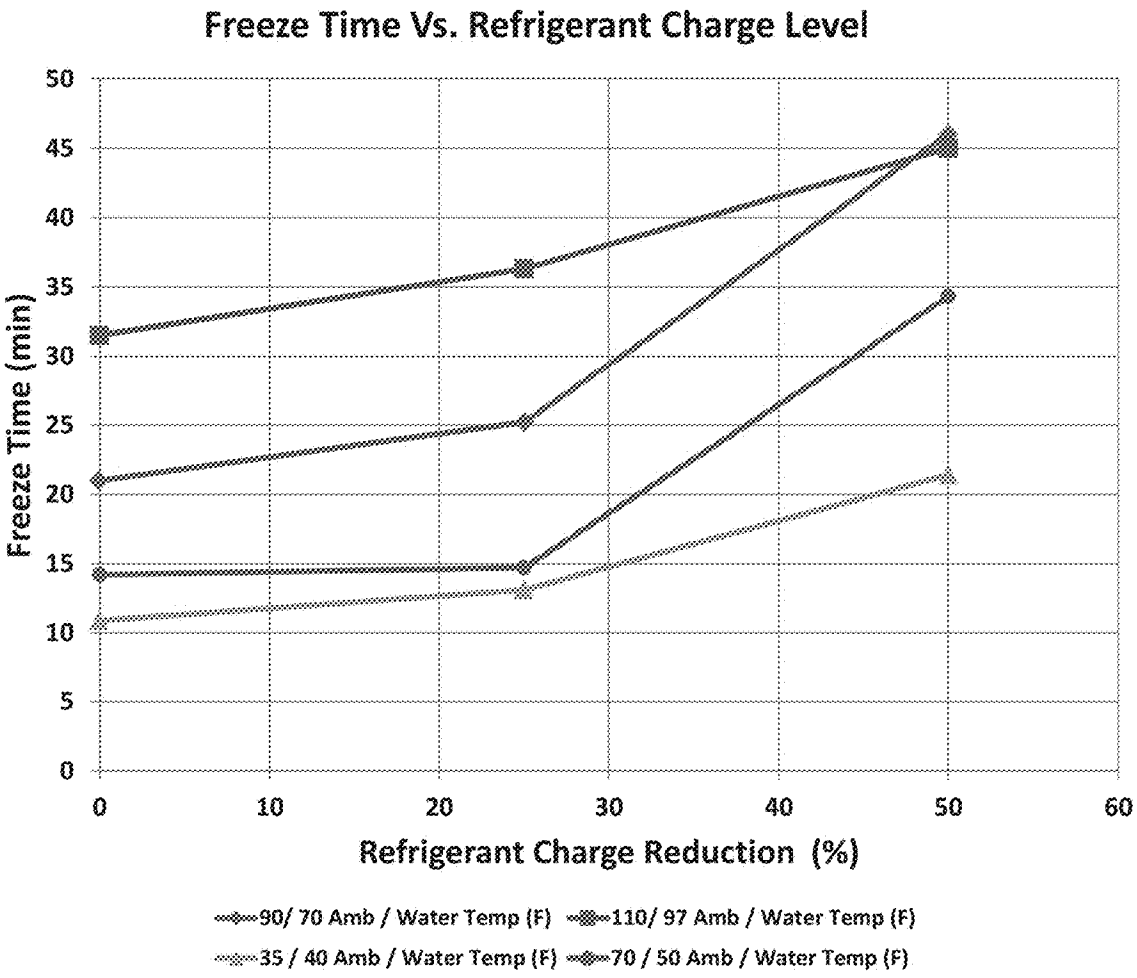
FIG. 8 is a graph of freeze time versus refrigerant charge level for use in determining loss in refrigerant charge.

As previously referenced, FIG. 8 is a system operation map illustrating freeze time versus refrigerant charge level at various ambient and water temperatures. For example, freeze time versus refrigerant charge level is illustrated for 35° F. ambient/40° F. water, 70° F. ambient/50° F. water, 50° F. ambient/70° F. water, and 110° F. ambient/97° F. water. These temperature combinations are typical ice machine rating combinations where, for example, 70/50° F. is standard for open residential or hotel environments and 90/70° F. is standard for a kitchen environment. As shown, freeze time increases as refrigerant charge decreases (refrigerant charge reduction increases), especially beyond 25% refrigerant charge reduction where the accuracy of the numbers drastically increases. Therefore, while an exact refrigerant charge level can be determined by use of additional sensors and calculations, for purposes of system diagnostics, the refrigerant charge reduction can be determined by the state and trend of the freeze time and can be approximated beyond 25% refrigerant charge reduction for purposes of system diagnosis and protection.

Figure 9:
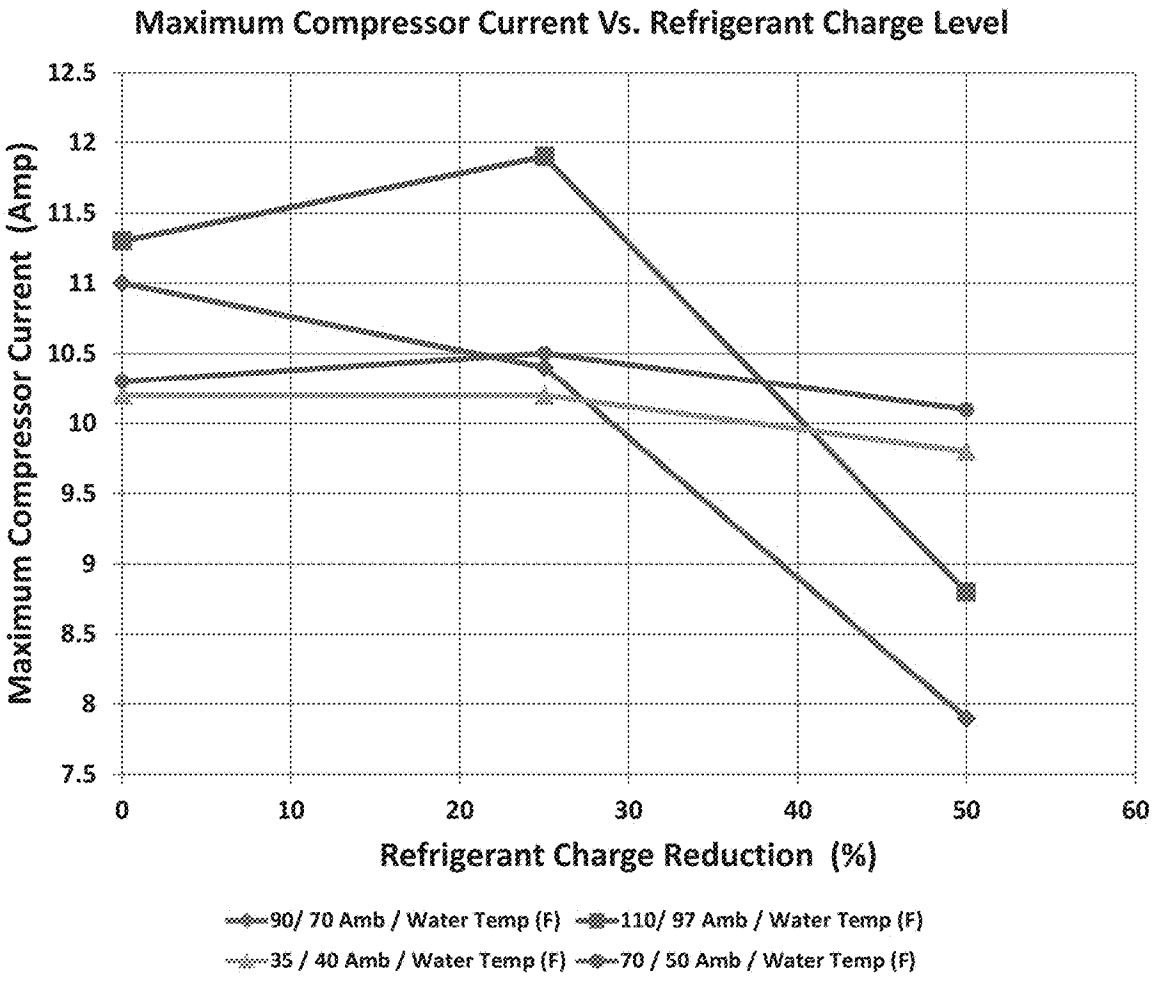
FIG. 9 is a graph of maximum compressor current versus refrigerant charge level for use in determining loss in refrigerant charge.

As previously referenced, a compressor map is provided in FIG. 9 showing maximum compressor current versus refrigerant charge level at various ambient and water temperatures. For example, similarly to FIG. 8, maximum discharge temperature versus refrigerant charge level is illustrated for 35° F. ambient/40° F. water, 70° F. ambient/50° F. water, 50° F. ambient/70° F. water, and 110° F. ambient/97° F. water. As shown, current decreases as refrigerant charge decreases (or refrigerant charge reduction increases) beyond 25% refrigerant charge reduction, where the accuracy of the numbers drastically increases. Therefore, while an exact refrigerant charge level can be determined by use of additional sensors and calculations, for purposes of system diagnostics, the refrigerant charge level can be determined by the state and trend of the compressor current and can be approximated beyond 25% refrigerant charge reduction for purposes of system diagnosis and protection.

Figure 10:
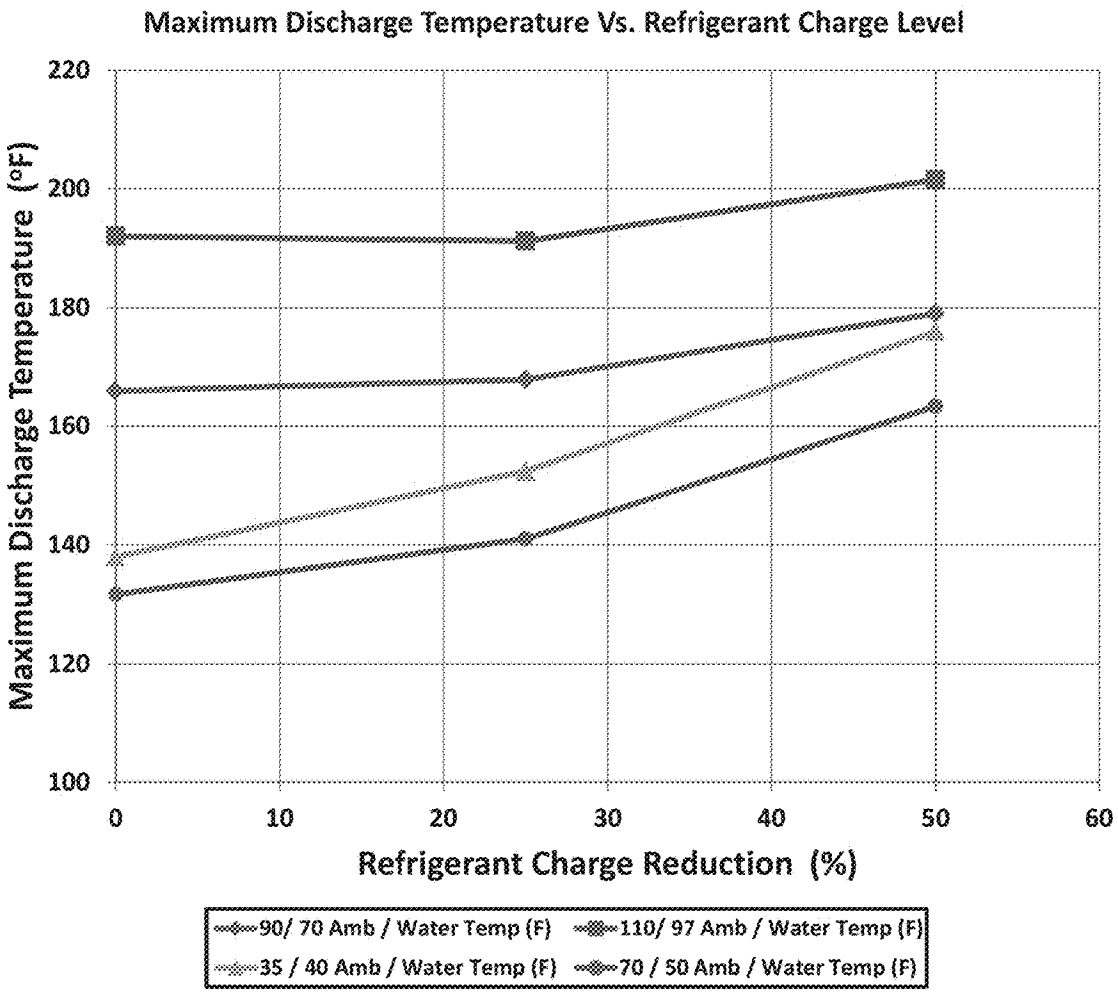
FIG. 10 is a graph of maximum discharge temperature versus refrigerant charge level for use in determining loss in refrigerant charge.

FIG. 10, as previously referenced, illustrates the relationship between maximum discharge temperature versus refrigerant charge level at various ambient and water temperatures. For example, maximum discharge temperature versus refrigerant charge level is illustrated for 35° F. ambient/40° F. water, 70° F. ambient/50° F. water, 50° F. ambient/70° F. water, and 110° F. ambient/97° F. water. As previously stated, these temperature combinations are typical ice machine rating combinations where, for example, 70/50° F. is standard for open residential or hotel environments and 90/70° F. is standard for a kitchen environment. As shown, maximum discharge temperature increases as refrigerant charge decreases (refrigerant charge reduction increases), especially beyond 25% refrigerant charge reduction where the accuracy of the numbers drastically increases. Therefore, while an exact refrigerant charge level can be determined by use of additional sensors and calculations, for purposes of system diagnostics, the refrigerant charge reduction can be determined by the state and trend of the maximum discharge temperature and can be approximated beyond 25% refrigerant charge reduction for purposes of system diagnosis and protection.

Figure 11:
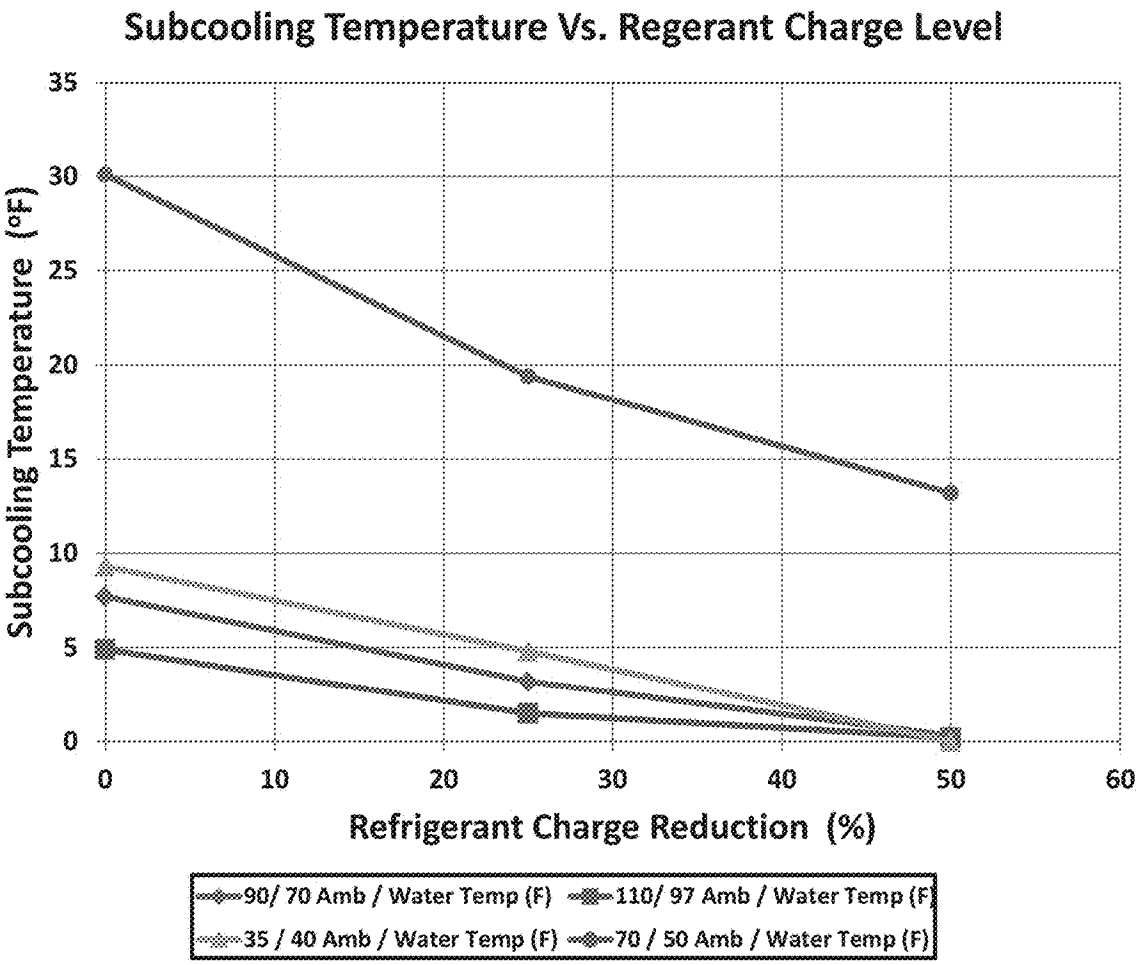
FIG. 11 is a graph of condenser subcooling temperature versus refrigerant charge level for use in determining loss in refrigerant charge.

FIG. 11, as previously referenced, illustrates the relationship between subcooling temperature versus refrigerant charge level at various ambient and water temperatures. For example, subcooling temperature versus refrigerant charge level is illustrated for 35° F. ambient/40° F. water, 70° F. ambient/50° F. water, 50° F. ambient/70° F. water, and 110° F. ambient/97° F. water. As previously described, subcooling temperature can be determined by subtracting the liquid-line temperature, as indicated by the liquid-line temperature sensor 84, from the condenser temperature and then subtracting an additional small value (typically 2-3° F.) representing the pressure drop between an outlet of the compressor 10 and an outlet of the condenser 70.

As shown, subcooling temperature decreases as refrigerant charge decreases (refrigerant charge reduction increases). Therefore, while an exact refrigerant charge level can be determined by use of additional sensors and calculations, for purposes of system diagnostics, the refrigerant charge reduction can be determined by the state and trend of the subcooling temperature and can be approximated beyond 25% refrigerant charge reduction for purposes of system diagnosis and protection.

Figure 12:
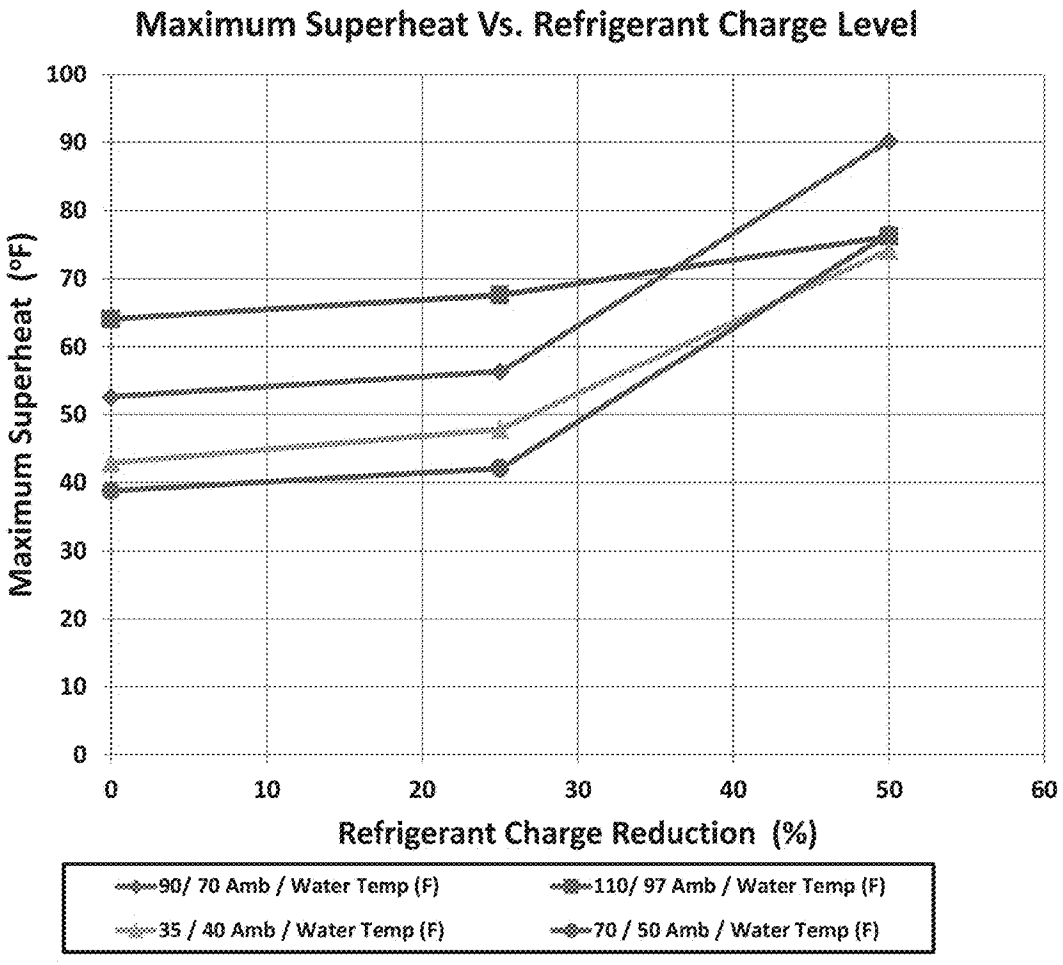
FIG. 12 is a graph of maximum compressor superheat temperature versus refrigerant charge level for use in determining loss in refrigerant charge.

As previously referenced, FIG. 12 is a system operation map illustrating maximum superheat temperature versus refrigerant charge level at various ambient and water temperatures. For example, maximum superheat temperature versus refrigerant charge level is illustrated for 35° F. ambient/40° F. water, 70° F. ambient/50° F. water, 50° F. ambient/70° F. water, and 110° F. ambient/97° F. water. As previously described, maximum superheat temperature can be determined by taking the difference between discharge line temperature and condenser temperature.

As shown, maximum superheat temperature increases as refrigerant charge decreases (refrigerant charge reduction increases), especially beyond 25% refrigerant charge reduction where the accuracy of the numbers drastically increases. Therefore, while an exact refrigerant charge level can be determined by use of additional sensors and calculations, for purposes of system diagnostics, the refrigerant charge reduction can be determined by the state and trend of the freeze time and can be approximated beyond 25% refrigerant charge reduction for purposes of system diagnosis and protection.

While only sensors 80, 82, 84, 86, 92, 110 were discussed in the foregoing description, it is understood that other sensors may be included in the system 12 and utilized to provide the desired system parameters. Further, while freeze time was discussed in relation to determining the refrigerant charge level, it is understood that additional parameters such as compressor current, discharge temperature, condenser subcooling, compressor superheat, ambient air temperature, water inlet temperature, and other known parameters may be used, either instead of or in addition to freeze time, to monitor the change in refrigerant charge and to make the charge detection algorithm more robust.

Throughout this application, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores data and/or code executed by a processor; other suitable hardware components that provide the described functionality; or a combination of some or all of the above, such as in a system-on-chip.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A system comprising:

a compressor driven by a motor;

a condenser receiving working fluid from said compressor;

an evaporator in fluid communication with said condenser and said compressor;

a first sensor producing a first signal;

a second sensor producing a second signal; and a processing circuitry processing said first signal and said second signal to determine a new baseline freeze time, wherein said processing circuitry determines said new baseline freeze time for a predetermined time following an installation event, a service event, or a power outage of said compressor.

2. The system of claim 1, wherein said first sensor produces said first signal which is indicative of one of current and power drawn by said motor.

3. The system of claim 2, wherein said second sensor produces said second signal which is indicative of a discharge line temperature.

4. The system of claim 3, further comprising a third sensor producing a third signal indicative of evaporator temperature; and a fourth sensor producing a fourth signal indicative of liquid line temperature, wherein said processing circuitry processes said second signal and said third signal to determine a calculated compressor superheat temperature and processes said first signal, said third signal, and said fourth signal to determine a calculated condenser subcooling temperature.

5. The system of claim 4, wherein said processing circuitry compares one or more of said calculated freeze time, said calculated compressor superheat temperature, and said calculated condenser subcooling temperature, to a stored, previously-generated, baseline freeze time, baseline compressor super heat temperature, and baseline condenser subcooling temperature, respectively.

6. The system of claim 5, wherein said processing circuitry determines whether a difference between one or more of said calculated freeze time, said calculated compressor superheat temperature, and said calculated condenser subcooling temperature, and the stored, previously-generated, baseline freeze time, baseline compressor super heat temperature, and baseline condenser subcooling temperature, respectively, is less than a predetermined threshold.

7. The system of claim 6, wherein when said difference is less than said predetermined threshold, said processing circuitry averages said one or more of said calculated freeze time, said calculated compressor superheat temperature, and said calculated condenser subcooling temperature with said baseline freeze time, baseline compressor super heat temperature, and baseline condenser subcooling temperature, respectively, to generate a new baseline value.

8. The system of claim 6, wherein when said difference is greater than said predetermined threshold, said processing circuitry determines a loss of charge condition based on said calculated freeze time, said first signal, and said second signal.

9. The system of claim 8, wherein said processing circuitry additionally utilizes one or more of a condenser temperature, said calculated condenser subcooling temperature, said calculated compressor superheat temperature, an ambient air temperature, and a water inlet temperature to determine said loss of charge condition.

10. The system of claim 3, wherein said processing circuitry processes said first signal and said second signal to determine a calculated freeze time.

11. The system of claim 10, wherein said processing circuitry compares said calculated freeze time to a stored, previously-generated, baseline freeze time.

12. The system of claim 11, wherein said processing circuitry determines whether a difference between said calculated freeze time and said baseline freeze time is less than a predetermined threshold.

13. The system of claim 12, wherein when said difference is less than said predetermined threshold and said calculated freeze time is different from said baseline freeze time, said processing circuitry averages said calculated freeze time with said baseline freeze time to generate a new baseline freeze time.

14. The system of claim 12, wherein said predetermined threshold is 20% greater than said baseline freeze time.

15. The system of claim 12, wherein when said difference is greater than said predetermined threshold, said processing circuitry determines a loss of charge condition based on said calculated freeze time, said first signal, and said second signal.

16. The system of claim 15, wherein said processing circuitry additionally utilizes one or more of a condenser temperature, a condenser subcooling, a compressor superheat, an ambient air temperature, and a water inlet temperature to determine said loss of charge condition.

17. The system of claim 1, wherein said predetermined time is fourteen days.

18. A method comprising:

detecting, by a first sensor, a first signal;

detecting, by a second sensor, a second signal;

processing, by a processing circuitry, said first signal and said second signal; and determining, by a processing circuitry a new baseline freeze time from the first signal and the second signal, wherein said new baseline freeze time is determined for a predetermined time following an installation event, a service event, or a power outage of a compressor.

19. The method of claim 18, further comprising:

producing, by said first sensor, said first signal which is indicative of one of current and power drawn by a motor of said compressor; and producing, by said second sensor, said second signal which is indicative of a discharge line temperature.

20. The method of claim 19, further comprising processing, by said processing circuitry, said first signal and said second signal to determine a calculated freeze time.

21. The method of claim 20, further comprising comparing, by said processing circuitry, said calculated freeze time to a stored, previously-generated, baseline freeze time.

22. The method of claim 21, further comprising determining, by said processing circuitry, whether a difference between said calculated freeze time and said baseline freeze time is less than a predetermined threshold.

23. The method of claim 22, further comprising averaging, by said processing circuitry, said calculated freeze time with said baseline freeze time to generate a new baseline freeze time when said difference is less than said predetermined threshold and said calculated freeze time is different from said baseline freeze time.

24. The method of claim 22, wherein said predetermined threshold is 20% greater than said baseline freeze time.

25. The method of claim 22, further comprising determining, by said processing circuitry, a loss of charge condition based on said calculated freeze time, said first signal, and said second signal when said difference is greater than said predetermined threshold.

26. The method of claim 25, determining, by said processing circuitry, said loss of charge condition by additionally utilizing one or more of a condenser temperature, a condenser subcooling temperature, a compressor superheat temperature, an ambient air temperature, and a water inlet temperature.

* * * * *